US012042041B1

(12) United States Patent
Mussare

(10) Patent No.: US 12,042,041 B1
(45) Date of Patent: Jul. 23, 2024

(54) EXTENDABLE GARMENT HANGING APPARATUS

(71) Applicant: John Mussare, South Williamsport, PA (US)

(72) Inventor: John Mussare, South Williamsport, PA (US)

( * ) Notice: Subject to any disclaimer, the term of this patent is extended or adjusted under 35 U.S.C. 154(b) by 0 days.

(21) Appl. No.: 18/135,944

(22) Filed: Apr. 18, 2023

(51) Int. Cl.
*A47B 61/02* (2006.01)
*A47B 61/00* (2006.01)
*A47G 25/06* (2006.01)

(52) U.S. Cl.
CPC ..... *A47B 61/02* (2013.01); *A47B 61/003* (2013.01); *A47G 25/0664* (2013.01); *A47G 25/0685* (2013.01); *A47G 25/06* (2013.01)

(58) Field of Classification Search
CPC ..... A47B 61/003; A47B 61/02; A47B 61/00; A47G 25/06; A47G 25/0664; A47G 25/0685; A47G 25/0607; A47G 25/74; A47G 25/743; A47F 7/12; A47F 7/18; A47F 7/19; A47F 7/22; A47F 7/24; A47F 7/26; A47F 5/10
See application file for complete search history.

(56) References Cited

U.S. PATENT DOCUMENTS 1,361,070 A * 12/1920 Kendall ..... A47B 61/003 248/278.1
1,361,739 A * 12/1920 Matheson ..... A47B 61/003 224/927
4,111,309 A * 9/1978 Henry ..... A47B 61/02 211/180
4,995,516 A * 2/1991 Fine ..... A47B 61/003 211/85.3
5,865,517 A * 2/1999 Wang ..... A47B 45/00 211/175
6,896,341 B2 * 5/2005 Cattoire ..... A47B 61/00 312/205
7,246,561 B2 * 7/2007 Weatherly ..... A47B 45/00 312/201
D606,180 S * 12/2009 Bock ..... D6/668.1
D606,181 S * 12/2009 Bock ..... D6/668.1
D606,635 S * 12/2009 Bock ..... D6/668.2
9,138,052 B2 * 9/2015 Kagramanyan ..... A47B 61/04
10,863,646 B1 * 12/2020 Rampey ..... A47B 61/02
11,116,314 B1 * 9/2021 Zhang ..... G06Q 10/08
(Continued)

*Primary Examiner* — Devin K Barnett
(74) *Attorney, Agent, or Firm* — Sanchelima & Associates, P.A.; Christian Sanchelima; Jesus Sanchelima

(57) ABSTRACT

An extendable garment hanging apparatus including a housing assembly, a hanging assembly, and a deployable assembly. The housing assembly includes a housing to receive and store garment in a small space, wherein the housing includes vents and an atomizer to keep the garments fresh. The hanging assembly includes a bar configured to be deployed and retracted from the interior of the housing when the door is opened and closed by means of a pulley mechanism, where the bar is adapted to hold the garment. The bar is hingedly attached to a support, wherein the support is coupled to a rail track, allowing the support and the bar to be lifted when opening the door, allowing the user to reach the garments separated therebetween. The user may retract the bar by pressing a button that actuates an extendable mechanism, allowing the bar and the door to return in a closed configuration.

15 Claims, 4 Drawing Sheets

(56) References Cited

U.S. PATENT DOCUMENTS

| | | | | |
|---|---|---|---|---|
| 2010/0059462 | A1* | 3/2010 | Jones | A47B 61/003 211/85.3 |
| 2020/0000223 | A1* | 1/2020 | O'Day | E06B 3/367 |
| 2020/0080250 | A1* | 3/2020 | Chang | D06F 59/02 |
| 2023/0104539 | A1* | 4/2023 | Telthörster | A47B 46/005 211/123 |

* cited by examiner

EXTENDABLE GARMENT HANGING APPARATUS

II. BACKGROUND OF THE INVENTION

1. Field of the Invention

The present invention relates to a garment hanging apparatus and, more particularly, to an extendable garment hanging apparatus that includes a closet with a deployable pole that is extended when opening the door of the closet and is retracted by means of a spring-loaded mechanism manually actuated.

2. Description of the Related Art

Several designs for extendable garment hanging apparatus have been designed in the past. None of them, however, include a housing including a deployable pole which is adapted to hold garments by means of interleaved openings, wherein the pole is deployed by means of a pulley mechanism and retracted by means of a spring-loaded mechanism actuated by a button.

Applicant believes that a related reference corresponds to U.S. Pat. No. 4,111,309 issued for adjustable garment assembly. Applicant believes that another related reference corresponds to U.S. Pat. No. 5,865,517 issued for coat rack cabinet combination. None of these references, however, teach of a front and rear support with an extendable line or rod hingedly mounted to the top of each, wherein the front support extends outward and the rod is moved from a vertical position to a horizontal position.

Other documents describing the closest subject matter provide for a number of more or less complicated features that fail to solve the problem in an efficient and economical way. None of these patents suggest the novel features of the present invention.

III. SUMMARY OF THE INVENTION

It is one of the objects of the present invention to provide a device that can be used in reduced spaces such as apartments, RV's, trailers, etc.

It is another object of this invention to provide a device with a special bar to hang garments in a fashion that does not degrade nor damage them.

It is still another object of the present invention to provide a device with a special mechanism that deploys and retracts the bar that holds the garment to save space.

It is yet another object of this invention to provide such a device that is inexpensive to implement and maintain while retaining its effectiveness.

Further objects of the invention will be brought out in the following part of the specification, wherein detailed description is for the purpose of fully disclosing the invention without placing limitations thereon.

IV. BRIEF DESCRIPTION OF THE DRAWINGS

Figure 1:
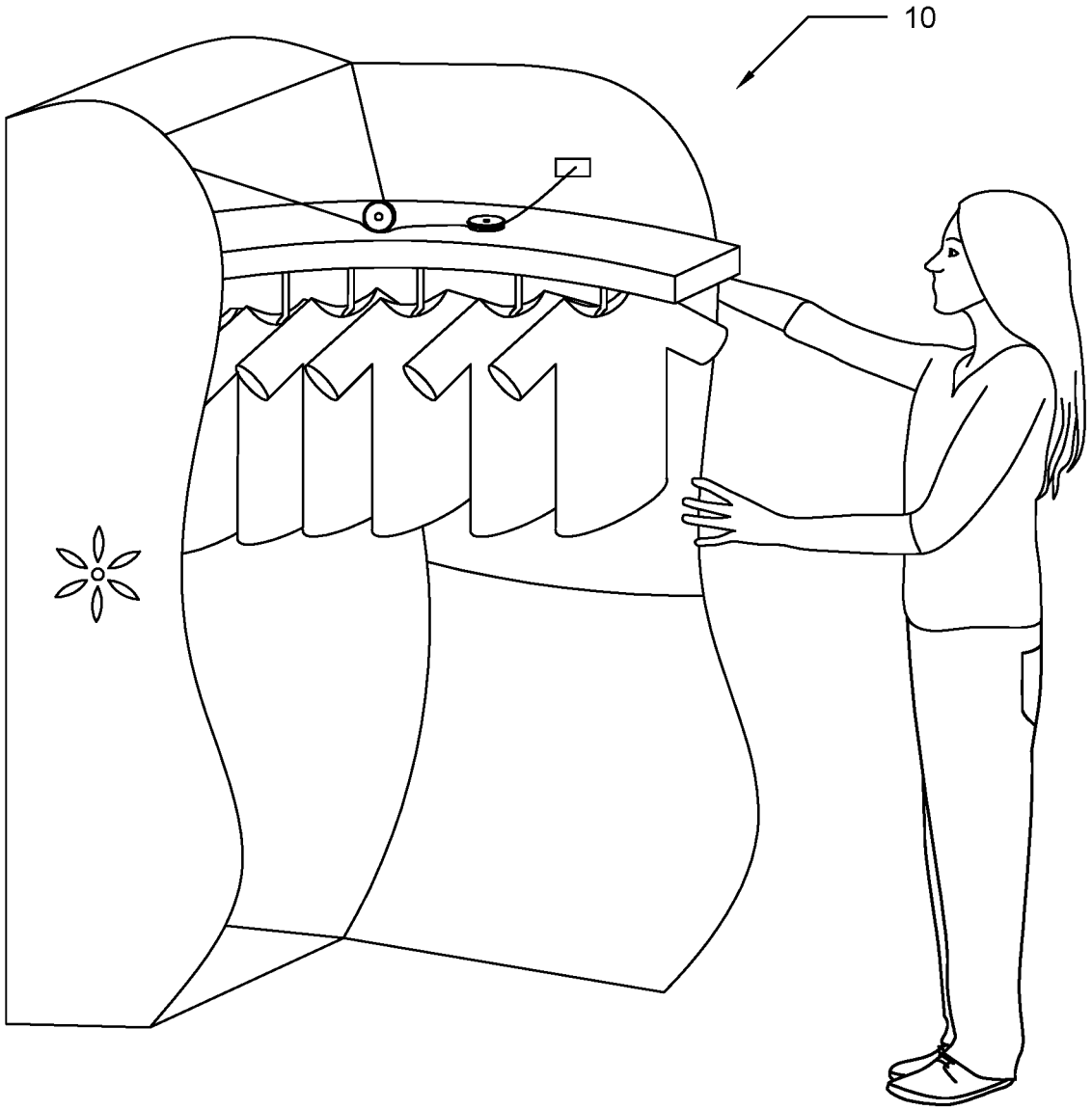

With the above and other related objects in view, the invention consists in the details of construction and combination of parts as will be more fully understood from the following description, when read in conjunction with the accompanying drawings in which:

FIG. 1 represents an operational view of an exemplary embodiment of the present invention 10.

Figure 2:
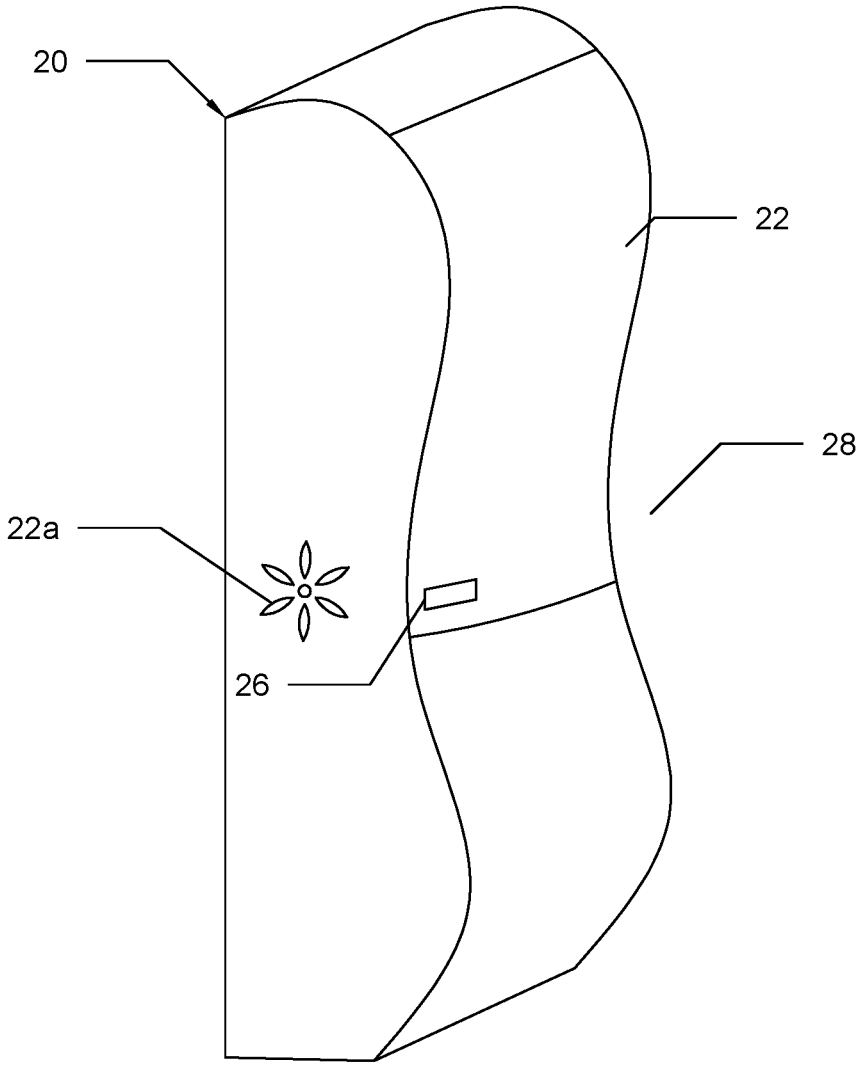

FIG. 2 shows an isometric view of the housing assembly 20, wherein in a lateral side of the housing 22 include vents 22*a* to let air flow in and out. The door 28 includes a handle where the user may manually open the door 28.

Figure 3:
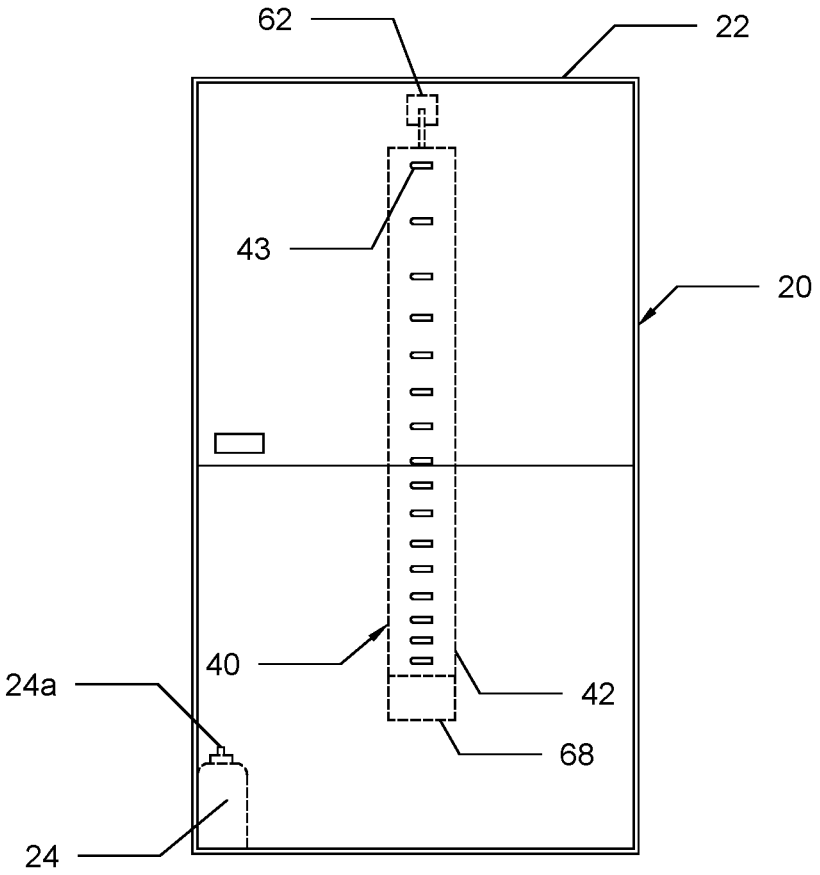

FIG. 3 illustrates a front see-through view of the housing 22 to illustrate the bar 42 in a retracted configuration, where the bar 42 includes a plurality of swivel hooks 43 along a bottom side thereof.

Figure 4:
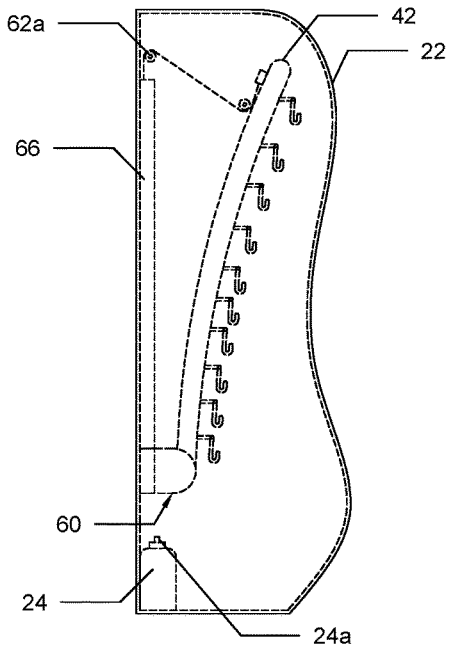

FIG. 4 is a representation of a lateral see-through view of the present invention 10 when the door 28 is closed and the bar 42 is in a retracted configuration, where the bar is held in place by means of a pulley mechanism 62.

Figure 5:
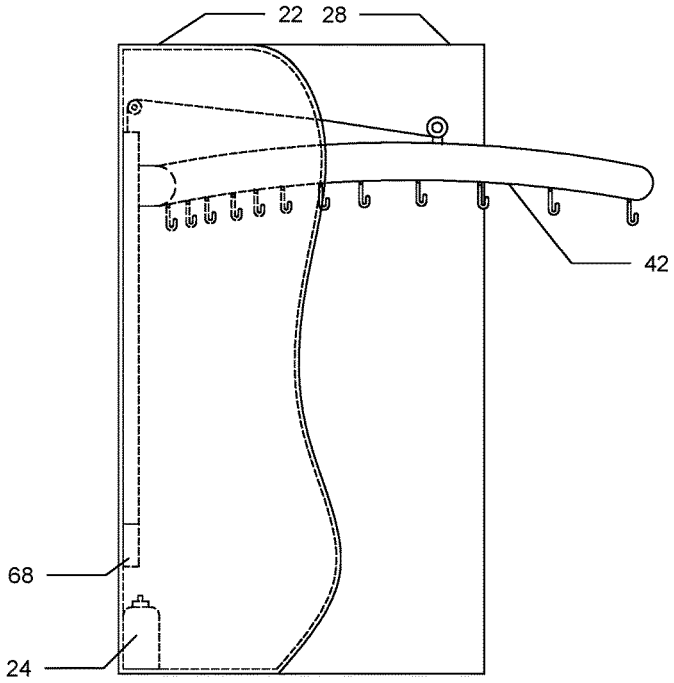

FIG. 5 is a depiction of a lateral see-through view when the door 28 is opened and the bar 42 is deployed by means of the pulley mechanism 62 and lifted along the rail track 66.

V. DETAILED DESCRIPTION OF THE EMBODIMENTS OF THE INVENTION

Referring now to the drawings, where the present invention is generally referred to with numeral 10, it can be observed that it basically includes a housing assembly 20, a hanging assembly 40, and a deployable assembly 60. It should be understood there are modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

Housing assembly 20 includes a housing 22, vents 22*a*, a container 24, an atomizer 24*a*, a handle 26, a door 28. In an exemplary embodiment, the housing 22, may be a receptacle configured to store garment, wherein the housing 22 may include a base, lateral walls, a top cover, a rear wall and a hinged door 28. In a suitable variation the base of the housing 22 may include wheels coupled in a bottom side thereof, allowing the housing 22 to be movable. In a suitable embodiment the housing may be made of wood, plywood, MDF, nylon, a combination thereof, or any other suitable material to protect garment from moisture, dust and the like. It should be considered that the shape housing may not be limited by the figures presented and may include a plurality of shapes that allows garment to be stored therein, wherein the housing 22 may include decorative indicia to represent a predetermined figure or figures. Referring to FIG. 3, the housing 22 may include a container 24 removably attachable from the interior thereof, where the container 24 may be a receptacle to contain a liquid substance such water, flavored water or the like, said liquid substance may be sprayed towards the interior of the housing 22 by means of an atomizer 24*a*. In one embodiment, the door 28 hingedly attached to the housing 22 includes a handle in a front side thereof, as FIG. 2 illustrates, wherein the handle 26 may have a recessed portion configured to receive the user's hand to pull said handle and open the door 28, thereby the handle 26 may conform with the shape of the front surface of the door 28. As FIG. 1 represents. Nonetheless, it should be considered that the handle may be any other suitable attachment mounted on the front surface of the door 28 to be grasped and manipulated by the user's hand.

FIG. 2 illustrates the vents 22*a* placed in a lateral wall of the housing 22, although vents 22*a* may be openings placed in any other side of the housing 24, allowing air to flow through the housing 22. It should be considered that the housing 22 may include a plurality of vents along thereof or the housing 22 may not include the vents 22*a* preventing an external agent from entering towards the interior of the housing 22.

Hanging assembly 40 includes a bar 42 and a plurality of swivel hooks 43. In an exemplary embodiment, the bar 42 may have a suitable cuboid length to be placed vertically inside the housing 22, as FIG. 3 illustrates, wherein the bar 42 may be hingedly attached to the internal side of the rear wall of the housing 22 by means of a support 68. In a preferred embodiment, the bar 42 may include the plurality of swivel hooks 43 in a bottom side thereof, said plurality of swivel hooks 43 may be interleaved one from each other with an increasing separation from the bottom to the top, as best depicted in FIG. 3, thus garment may be hanged from the plurality of swivel hooks 43 by means of any suitable hanging device. In a suitable embodiment, a portion of the length of each of the plurality of swivel hooks 43 may increase with respect to the previous one, allowing garment to be stacked vertically interleaved. As best illustrated in FIG. 4. It should be considered that the bar 42 may be made of wood, hard plastic, aluminum, alloy steel, or any other suitable material that supports a load beam caused by stacked garments weight along the bar 42. As FIG. 1 shows.

Deployable assembly 60 includes a pulley mechanism 62, a button 64, a rail track 66, and the support 68. In an exemplary embodiment, the pulley mechanism 62 may include a first pulley 62*a*, a second pulley 62*b*, a third pulley 62*c*, and a cable 63, wherein a portion of the cable 63 pass through the rails track 66 and a proximal end of the cable 63 is attached to an extendable mechanism such as spring-loaded mechanism, a piston, a linear device, or any other suitable mechanism included inside the rail track 66 (not shown in figures) that allows the cable to slide upward and downward thereof. in a preferred embodiment, the cable 63 may pass through the first pulley 62*a* placed parallel above the rail track 66, and further pass through the second pulley 62*b* and third pulley 62*c* coupled on a top side of the bar 42, as best illustrated in FIG. 1, wherein the third pulley is mounted horizontal with respect to the second pulley 62*b* allowing the cable to change the direction toward the door 28 where a distal end of the cable 63 is attached. As FIG. 1 depicts. It should be considered that the cable 63 may be made of a suitable material that supports the load beam caused by the weight of the bar 42 including the weight of garments. In a suitable embodiment, the rail track 66 may be a linear guide attached to the internal side of the rear wall of the housing 22, wherein in a bottom side thereof the support 68 is coupled, thereby. The support 68 and the bar are hingedly attached therebetween, allowing the bar to rotate from an inclined position to a horizontal position. As best depicted in FIG. 4 and FIG. 5 respectively.

FIG. 4 illustrates an inclined position of the bar 42 when the door is closed and FIG. 5 represents a horizontal position of the bar 42 when the door 28 is opened, thereby the door may pull the cable 63 while being opened, the cable 63 may lift the support 68 with the bar at the same time that the bar 42 is rotating into a horizontal position, allowing the garments to be reachable for the user. As FIG. 1 illustrates. The extendable mechanism housed inside the rail track 66 may allow locking the bar 42 by means of a locking mechanism in said horizontal configuration and may retract the bar when pressing a button 64 to unlock the extendable mechanism, allowing the bar 42 to return to its inclined position and closing the door 28. In one embodiment, the button 64 may be placed in a portion of the bar 42 which said button 64 is operatively connected to said extendable mechanism.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. An extendable garment hanging apparatus, comprising:

a) a housing assembly including a housing, a container, a handle, and a door, wherein the housing is a receptacle to store garments therein, said door is hingedly attached to said housing, said door is configured to be opened by means of the handle which is mounted onto an external surface of said housing, said container is configured to contain a liquid substance;

b) a hanging assembly having a bar, wherein said bar is stored inside said housing, said bar has a cuboid shape, wherein said bar is stored inside said housing in a vertical or inclined configuration, wherein said bar is deployable from being stored within an interior of said housing to an extended position that extends outside of the housing in a horizontal configuration;

c) a deployable assembly including a pulley mechanism, a button, a rail track, and a support, wherein said rail track is a linear guide attached to an internal rear wall of said housing, wherein said support is coupled in a front side of said rail track, said support and said bar are hingedly attached therebetween, said pulley mechanism allows said support to be slid along said rail track and to deploy said bar from being stored within the interior of said housing to the extended position, wherein said button is in a portion of said bar.

2. The extendable garment hanging apparatus of claim 1, wherein said housing includes vents in at least one side or wall that forms said housing.

3. The extendable garment hanging apparatus of claim 1, wherein said container includes an atomizer coupled on a top portion thereof to spray said liquid substance towards said interior of said housing.

4. The extendable garment hanging apparatus of claim 1, wherein said bar has a plurality of swivel hooks in a bottom side thereof.

5. The extendable garment hanging apparatus of claim 4, wherein said plurality of swivel hooks are spaced apart from each other, wherein said plurality of swivel hooks are each configured to receive a hanging device for said garments.

6. The extendable garment hanging apparatus of claim 1, wherein said bar is configured to support a weight of said garments thereon.

7. The extendable garment hanging apparatus of claim 1, wherein said pulley mechanism includes a first pulley, a second pulley, a third pulley, and a cable.

8. The extendable garment hanging apparatus of claim 7, wherein said rail track includes an extendable mechanism therein wherein a proximal end of said cable is attached to said extendable mechanism.

9. The extendable garment hanging apparatus of claim 8, wherein a distal end of said cable is attached to said door.

10. The extendable garment hanging apparatus of claim 7, wherein said first pulley is attached to a portion of said interior of said housing, said second pulley is attached to a top side of said bar, and said third pulley is attached to a portion of said bar in a horizontal configuration.

11. The extendable garment hanging apparatus of claim 8, wherein said extendable mechanism includes a locking mechanism that allows the bar to stay in the horizontal configuration.

12. The extendable garment hanging apparatus of claim 11, wherein said button is operatively connected to said extendable mechanism to unlock said locking mechanism allowing said bar to return to said vertical or inclined configuration when actuated.

13. The extendable garment hanging apparatus of claim 4, wherein a length of each swivel hook increases from a proximal end of said bar to a distal end of said bar.

14. An extendable garment hanging apparatus, comprising:

a) a housing assembly including a housing, a container, a handle, and a door, wherein the housing is a receptacle to store garments therein, said door is hingedly attached to said housing, said door is configured to be opened by means of the handle which is mounted onto an external surface of said housing, said container is configured to contain a liquid substance, said housing includes vents in at least one side or wall that forms said housing;

b) a hanging assembly having a bar, wherein said bar is stored inside said housing, said bar has a cuboid shape, wherein said bar is stored inside said housing in a vertical or inclined configuration, wherein said bar is deployable from being stored within an interior of said housing to an extended position that extends outside of the housing in a horizontal configuration, said bar has a plurality of swivel hooks in a bottom side thereof, wherein said plurality of swivel hooks are spaced apart from each other, wherein said plurality of swivel hooks are each configured to receive a hanging device for said garments;

c) a deployable assembly including a pulley mechanism, a button, a rail track, and a support, wherein said rail track is a linear guide attached to an internal rear wall of said housing, wherein said support is coupled in a front side of said rail track, said support and said bar are hingedly attached therebetween, said pulley mechanism allows said support to be slid along said rail track and to deploy said bar from being stored within the interior of said housing to the extended position, wherein said button is in a portion of said bar, said pulley mechanism includes a first pulley, a second pulley, a third pulley, and a cable, said rail track includes an extendable mechanism therein wherein a proximal end of said cable is attached to said extendable mechanism.

15. An extendable garment hanging apparatus, comprising:

a) a housing assembly including a housing, a container, a handle, and a door, wherein the housing is a receptacle to store garments therein, said door is hingedly attached to said housing, said door is configured to be opened by means of the handle which is mounted onto an external surface of said housing, said container is configured to contain a liquid substance, said housing includes vents in at least one side or wall that forms said housing, said container includes an atomizer coupled on a top portion thereof to spray said liquid substance towards said interior of said housing;

b) a hanging assembly having a bar, wherein said bar is stored inside said housing, said bar has a cuboid shape, wherein said bar is stored inside said housing in a vertical or inclined configuration, wherein said bar is deployable from being stored within an interior of said housing to an extended position that extends outside of the housing in a horizontal configuration, said bar has a plurality of swivel hooks in a bottom side thereof, wherein said plurality of swivel hooks are spaced apart from each other, wherein said plurality of swivel hooks are each configured to receive a hanging device for said garments, said bar is configured to support a weight of said garments thereon;

c) a deployable assembly including a pulley mechanism, a button, a rail track, and a support, wherein said rail track is a linear guide attached to an internal rear wall of said housing, wherein said support is coupled in a front side of said rail track, said support and said bar are hingedly attached therebetween, said pulley mechanism allows said support to be slid along said rail track and to deploy said bar from being stored within the interior of said housing to the extended position, wherein said button is in a portion of said bar, said pulley mechanism includes a first pulley, a second pulley, a third pulley, and a cable, said rail track includes an extendable mechanism therein wherein a proximal end of said cable is attached to said extendable mechanism, wherein a distal end of said cable is attached to said door, wherein said first pulley is attached to a portion of said interior of said housing, said second pulley is attached to a top side of said bar, and said third pulley is attached to a portion of said bar in a horizontal configuration, said extendable mechanism includes a locking mechanism that allows the bar to stay in the horizontal configuration, said button is operatively connected to said extendable mechanism to unlock said locking mechanism allowing said bar to return to said vertical or inclined configuration when actuated, wherein a length of each swivel hook increases from a proximal end of said bar to a distal end of said bar.

* * * * *